United States Patent [19]

Naz

[11] 3,958,917

[45] May 25, 1976

[54] SCENTED RING FOR CANDLES

[76] Inventor: John F. Naz, 6523 Wellesley Terrace, Waterford, Mich. 48095

[22] Filed: Sept. 10, 1973

[21] Appl. No.: 395,907

[52] U.S. Cl. ..... 431/289; 21/111

[51] Int. Cl.[2] ..... C11C 5/00

[58] Field of Search ..... 431/288, 289; 23/111

[56] References Cited

UNITED STATES PATENTS

| | | | |
|---|---|---|---|
| 2,254,906 | 9/1941 | Petrulis | 431/289 |
| 3,107,511 | 10/1963 | Hamsag-Garshanin | 431/288 |
| 3,388,960 | 6/1968 | Cangialosi | 431/126 |

FOREIGN PATENTS OR APPLICATIONS

| | | | |
|---|---|---|---|
| 909,032 | 11/1945 | France | 431/289 |

*Primary Examiner*—Carroll B. Dority, Jr.
*Attorney, Agent, or Firm*—Harness, Dickey & Pierce

[57] ABSTRACT

An odorizer for a candle is formed from a wax like material impregnated by an odoriferous composition. The odorizer is adapted to overlay the lighted end of the candle and includes an opening permitting the wick of the candle to extend therethrough. In response to combustion of the candle, a selective fragrance is produced to odorize the candle-lighted environment.

1 Claim, 4 Drawing Figures

SCENTED RING FOR CANDLES

BACKGROUND AND SUMMARY OF THE INVENTION

The present invention pertains generally to candles and more particularly to a combustible scent producing element adapted to be overlyingly located, supported, and consumed by the lighted end of the candle whereby to produce the desired fragrance.

Heretofore, scented candles have been provided which have derived their fragrance by the addition of various odoriferous ingredients impregnated in the body of the candle itself. While such candles have been generally effective in producing a selected aroma, there is little or no versatility with respect to changing from one fragrance to another without virtually replacing one scented candle of a particular fragrance with another. Since individual tastes with respect to a particular fragrance are fickle and in some instances are subject to wane during the expected life of the candle, it would be highle desirable and indeed economical if a single candlestick could be adapted to provide a particular scent for a given period of time and subsequently provide different scents to suit differing individual moods. In the present invention, an odoriferous member, preferably provided in one of a variety of fragrances, is located in the combustion end of a candlestick and consumed by the burning wick and parafin. Since the time interval for completely consuming an individual member is far less than the number of hours required to consume a complete candle, it is proposed that a single candle be utilized to produce one of a selective variety of fragrances by the addition of an auxiliary element. It, therefore, is a general object of the subject invention to provide a plurality of selective odors from a single candle element.

In another aspect of the present invention, it has been found that a market exists for candlesticks employing various flame coloring agents to provide a selective hue. Generally speaking, the process for producing such candles involves impregnating the candle body with such additives as, for example, strontium, copper, barium, lithium, etc. These same additives can also be impregnated in the odoriferous member of the present invention to provide a change of hue accompanying a change of fragrance. It, therefore, is another object of the present invention to provide an accessory for a candlestick adapted to provide a user with a choice of scent accompanied by a choice of flame color.

Other objects, features, and advantages of the present invention will become apparent from the subsequent description and the appended claims, taken in conjunction with the accompanying drawings.

DETAILED DESCRIPTION OF THE PREFERRED EMBODIMENT

Figure 1:
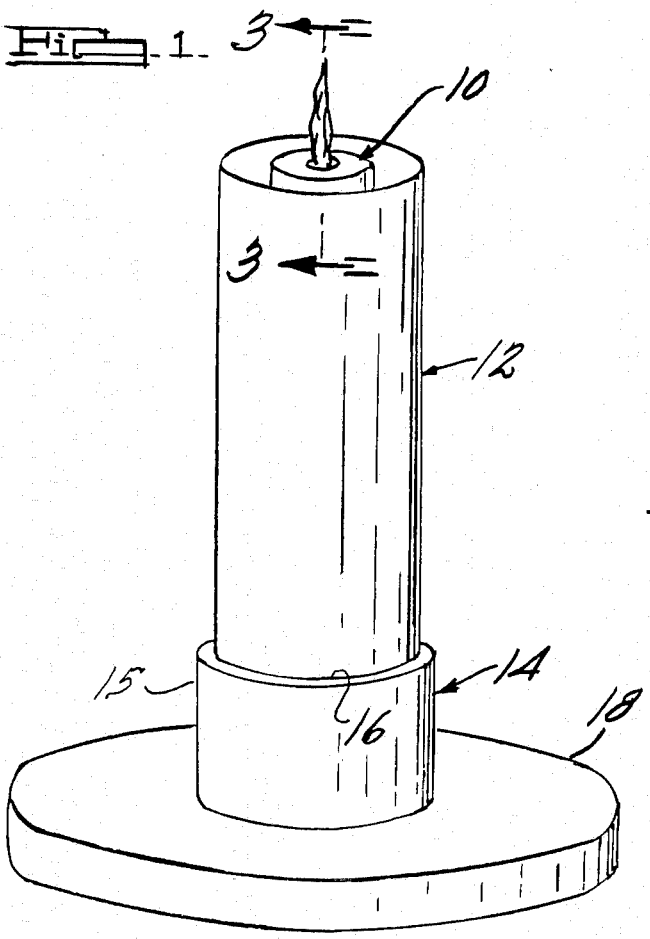
FIG. 1 is a perspective view of a candle supported at one end by a suitable candle holder and operatively supporting an odoriferous element at an opposite lighted end in accordance with a preferred embodiment of the present invention.

With reference to FIG. 1 of the drawings, an exemplary odoriferous member or candle accessory is indicated generally at 10 in operative relationship relative to an upper surface of a candle 12. The candle 12 can be of any ordinary type commercially available and forms no part of the present invention. The candle is supported by a suitable candle holder 14 which, by way of example, can include an annular shaped support section 15 having an inwardly extending passage 16, for cooperatively receiving a lower end of the candle. An enlarged radially extending base section 18 maintains the candle 12 in a substantially vertical orientation.

Figure 2:
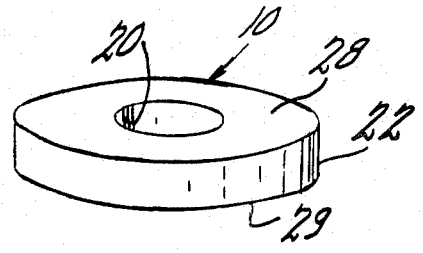
FIG. 2 is a perspective view of the odoriferous element illustrated in FIG. 1.
Figure 3:
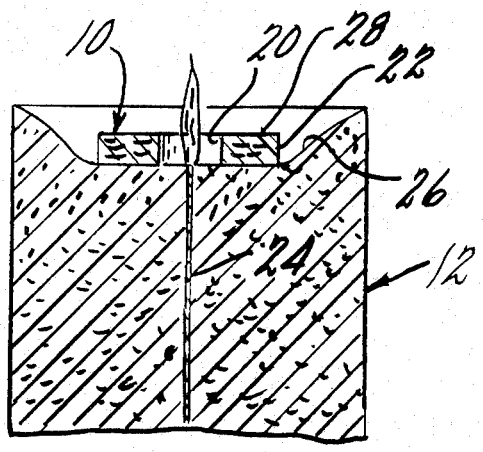
FIG. 3 is a fragmentary cross-sectional elevation of the upper end of the candle illustrated in FIG. 1 taken on the lines 3—3 thereof.
Figure 4:
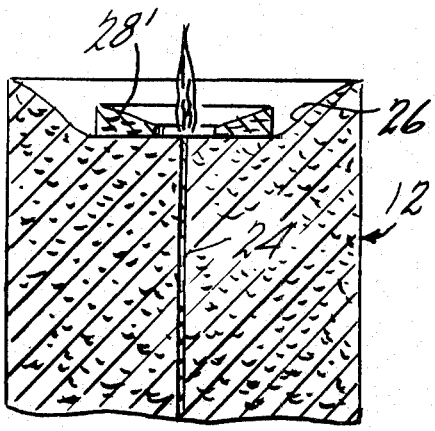
FIG. 4 is a fragmentary cross-sectional elevation similar to FIG. 3 illustrating the mode of consumption of the odoriferous element.

As best seen in FIG. 2, the odoriferous member 10 is annular shaped and comprises upper and lower relatively flat wall surfaces 28 and 29, relatively thin circumferentially extending sidewall 22 and a circularly shaped internal passage 20 formed on a diameter substantially larger than the diameter of a conventional wick 24. The sidewall 22 is formed on a diameter which is less than the outside diameter of the candle 12 whereby to facilitate placement in an inwardly projecting recess 26 formed at the upper end of the candle 12. The member 10 is fabricated of a heat responsive material, such as wax like or parafin material which in accordance with the present invention is impregnated by a selective odor producing ingredient or composition. In this regard and by way of example, the member 10 can be impregnated to provide one of a variety of fragrances that can be spicy, fruity, of flowers, of balsams or pieces of gum, etc. at the discretion of the candle user. In addition to one of the above scents, a coloring agent can also be impregnated into the member 10 to achieve a flame coloring hue to augment a particular fragrance in producing a desired atmosphere.

In use, the member 10 is initially disposed in overlaying relationship on the upper surface of the candle 12 with the wick 24 extending through the passage 20 in substantially coaxial relationship therewith. In response to lighting the wick and the subsequent combustion of the candle 12 and the heating of the member 10, the desired fragrance is released to the candle-lighted environment. Accordingly, the aroma is continued until the member 10 is completely consumed. Thereafter, the member 10 may be replaced with another member having either the same or a different selected fragrance to maintain or alter the environment or atmosphere of a particular space at the whim of the candle user.

It, therefore, will be seen that an accessory has been provided which is adapted to transform any ordinary candle to one providing a desired scent. Moreover, it will be noted that the member 10 is easily replaceable to facilitate a fragrance change to accommodate any mood of the user. It also will be seen that the odoriferous member can also include various flame coloring additives whereby to create a visual accompaniment to the fragrance produced.

While it will be apparent that the preferred embodiment of the invention disclosed is well calculated to fulfill the objects above stated, it will be appreciated that the invention is susceptible to modification, variation and change without departing from the proper scope or fair meaning of the subjoined claims.

What is claimed is:

1. A combination consisting solely of a candle having a one-piece monolythic cylindrical body of a combustible material and having a central axially upwardly projecting wick, and an odorizer element overlying the upper end of said candle, said odorizer element being annular in shape and formed from a material that is combustible and consumable entirely independent of said candle, whereby said element may be removed and replaced without in any way affecting the normal operation, size or volume of the combustible material of the candle body, said element being smaller in outer diameter than said candle body and including a central passage of a larger cross-sectional size than said wick and having said wick extend in relative spaced relationship upwardly therethrough when the element rests directly upon said upper end of said candle body; said element being impregnated with an odoriferous substance for providing a selective fragrance in response to combustion of said element.

* * * * *